US011788709B1

(12) United States Patent
Baker, Jr.

(10) Patent No.: US 11,788,709 B1
(45) Date of Patent: Oct. 17, 2023

(54) LIGHT COLOR EMISSION CHANGING SYSTEM AND METHOD

(71) Applicant: Alphonso Baker, Jr., Arlington, TX (US)

(72) Inventor: Alphonso Baker, Jr., Arlington, TX (US)

( * ) Notice: Subject to any disclaimer, the term of this patent is extended or adjusted under 35 U.S.C. 154(b) by 0 days.

(21) Appl. No.: 17/964,883

(22) Filed: Oct. 12, 2022

(51) Int. Cl.

| | |
|---|---|
| ***F21V 9/08*** | (2018.01) |
| ***F21V 23/04*** | (2006.01) |
| ***F21V 1/16*** | (2018.01) |
| *F21Y 115/10* | (2016.01) |

(52) U.S. Cl.
CPC ..... *F21V 9/08* (2013.01); *F21V 1/16* (2013.01); *F21V 23/04* (2013.01); *F21Y 2115/10* (2016.08)

(58) Field of Classification Search
CPC ... F21V 9/08; F21V 1/16; F21V 23/04; F21Y 2115/10
See application file for complete search history.

(56) References Cited

U.S. PATENT DOCUMENTS

| | | | | |
|---|---|---|---|---|
| 6,155,695 | A | 12/2000 | Sealy | |
| 6,745,136 | B2 | 6/2004 | Fung | |
| 7,176,606 | B2 | 2/2007 | Schaefer | |
| 8,317,365 | B2 | 11/2012 | Tracy | |
| 9,200,755 | B1 * | 12/2015 | Corey | F21K 9/23 |
| D770,080 | S | 10/2016 | Sanders | |
| 9,797,578 | B2 | 10/2017 | Wang | |
| 2006/0203498 | A1 | 9/2006 | Lin | |
| 2013/0148358 | A1 | 6/2013 | Harooni | |
| 2014/0191686 | A1 * | 7/2014 | Maxik | F21S 8/022 315/307 |
| 2018/0125762 | A1 * | 5/2018 | Fernandez | A61J 11/045 |
| 2019/0186725 | A1 * | 6/2019 | Vincent | H05K 1/181 |
| 2020/0018465 | A1 * | 1/2020 | Erdener | F21V 21/26 |

FOREIGN PATENT DOCUMENTS

JP 3146790 U * 12/2008

OTHER PUBLICATIONS

English Translation of JP-3146790-U , Shigehara (Year: 2008).*

* cited by examiner

*Primary Examiner* — Jong-Suk (James) Lee
*Assistant Examiner* — Glenn Zimmerman

(57) ABSTRACT

A light color emission changing system for changing the color of a white light emitting light source to a selected color includes a light fixture having a base and a socket. The base is mounted on a support and a light emitter is connected with the socket to emit light having a white hue when turned on. A covering is removably positionable over the light fixture such that only one color of light is emitted through the covering.

7 Claims, 4 Drawing Sheets

LIGHT COLOR EMISSION CHANGING SYSTEM AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to light color emission changing devices and more particularly pertains to a new light color emission changing device for changing the color of a white light emitting light source to a selected color.

(2) Description of Related Art Including Information Disclosed Under 37 CFR 1.97 and 1.98

The prior art relates to light color emission changing devices including a variety of devices configured for emitting a colored light from a light emitter. Known prior art lacks a covering being removably positionable over a light fixture.

BRIEF SUMMARY OF THE INVENTION

An embodiment of the disclosure meets the needs presented above by generally comprising a light fixture including a base including a socket. The base is mounted on a support and a light emitter is engaged with the socket to emit light having a white hue when turned on. A covering is removably positionable over the light fixture such that only one color of light is emitted through the covering.

Another embodiment of the disclosure comprises a method for changing a color of light emission includes extending a covering over a light fixture emitting a white hued light. The covering is translucent and colored a color such that light emitted through the covering is colored the color of the covering.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
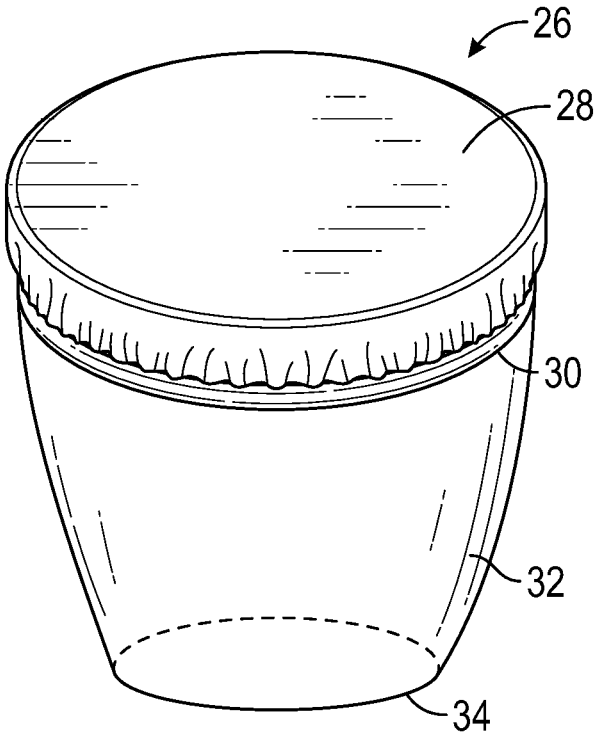
FIG. 1 is a top isometric view of a light color emission changing system to an embodiment of the disclosure.
Figure 2:
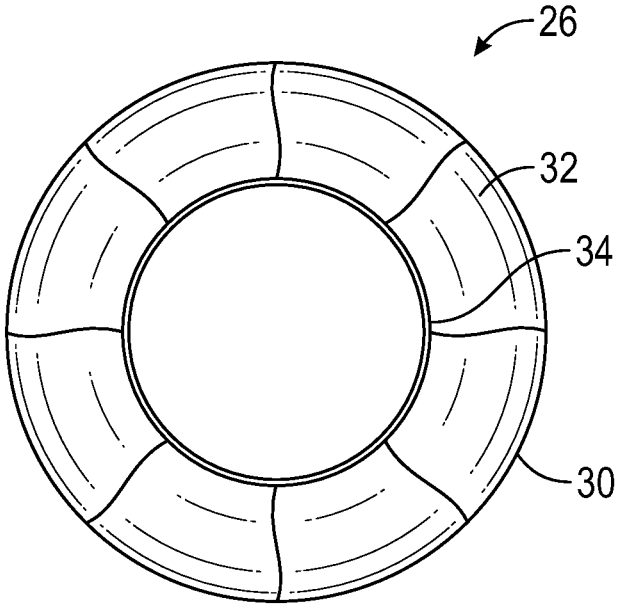
FIG. 2 is a bottom view of an embodiment of the disclosure.
Figure 3:
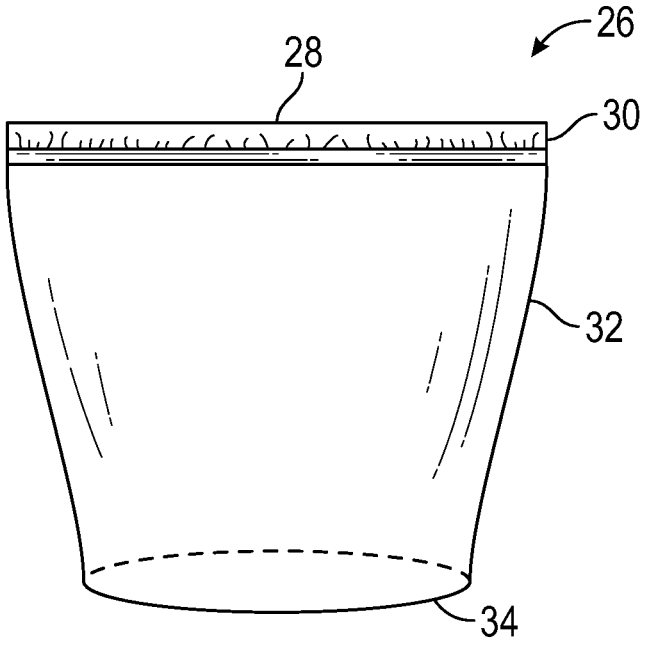
FIG. 3 is a front view of an embodiment of the disclosure.
Figure 4:
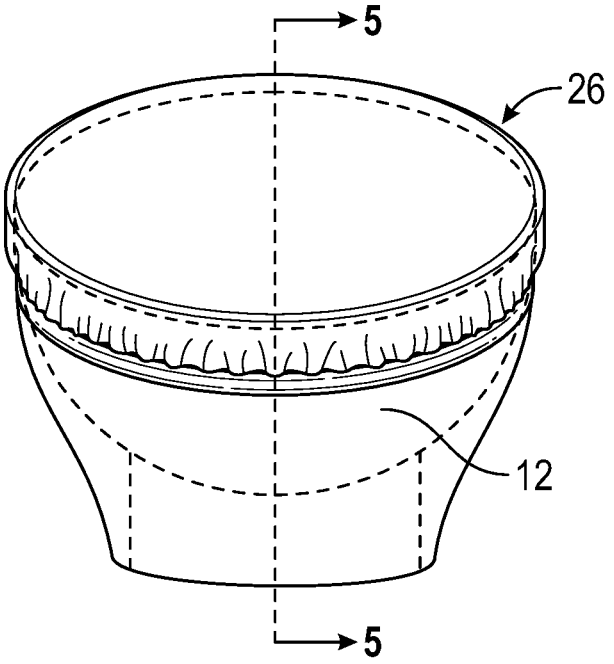
FIG. 4 is a perspective view of an embodiment of the disclosure.
Figure 5:
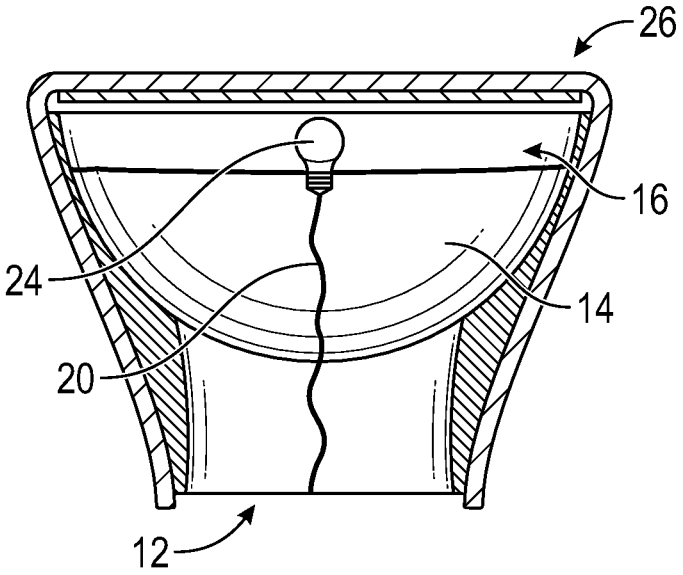
FIG. 5 is a cross-sectional view of an embodiment of the disclosure taken along Line 5-5 of FIG. 4.
Figure 6:
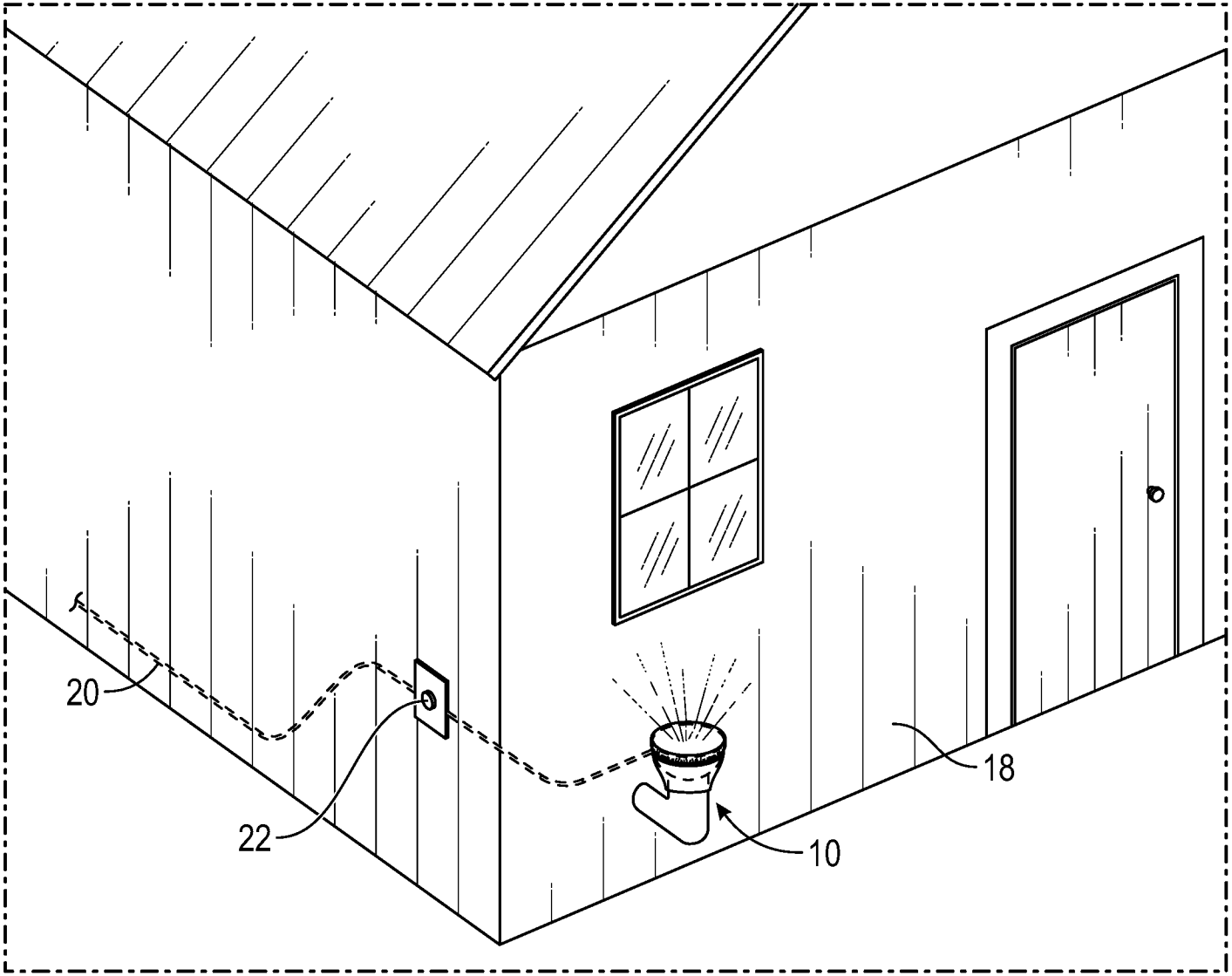
FIG. 6 is an in-use view of an embodiment of the disclosure.

With reference now to the drawings, and in particular to FIGS. 1 through 6 thereof, a new light color emission changing device embodying the principles and concepts of an embodiment of the disclosure and generally designated by the reference numeral 10 will be described.

As best illustrated in FIGS. 1 through 6, the light color emission changing system 10 generally comprises a light fixture 12 having a base 14 and a socket 16 being mounted on a support 18. The socket 16 is conventional for receiving a light bulb. The support 18 may comprise a house, a building, a lamp post, or any structure having a light fixture. The base 14 is electrically coupled to a power supply 20 and a switch 22 is electrically coupled to the base 14 for turning on and off the power supply 20 to the base 14. A light emitter 24 is engaged with the socket 16 and emits light when turned on. The emitted light has a white hue and may include warm, cool, or neutral levels of the white hue. The light emitter 24 will typically comprise a conventional light emitter such as a light emitting diode or an incandescent light bulb.

A covering 26 is removably positionable over the light fixture 12 such that only one color of light is emitted through the covering 26. The covering 26 comprises a translucent material and may comprise a plastic material such as high tempered polycarbonate. The covering 26 includes an end wall 28 having a perimeter edge 30. The end wall 28 may have a circular shape and be planar. A perimeter wall 32 is coextensive with and extends away from the perimeter edge 30 of the end wall 28. The perimeter wall 32 has a distal edge 34 with respect to the end wall 28. The distal edge 34 forms an opening for receiving the light fixture 12. The perimeter wall 32 may be resiliently stretchable and tapering inwardly from the end wall 28 to the distal edge 34.

In use, the covering 26 extends over the light fixture 12 emitting the white hued light. The light fixture 12 is then turned on and white light from the light emitter 24 is emitted through the covering 26 such that colored light is emitted from the light fixture 12. The covering 26 will typically comprise a known color such as red, orange, yellow, green, blue, or purple. The support 18 will typically comprise a house or a building such that the system 10 will emit colored light upon a wall of the house or building.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A light color emission changing system comprising:

a light fixture including:

a base including a socket being mounted on a support; and a light emitter being engaged with said socket and emitting light when turned on having a white hue;

a covering being removably positionable over the light fixture such that only one color of light is emitted through the covering, wherein said covering includes an end wall having a perimeter edge, said end wall having a circular shape, said end wall is planar; and a perimeter wall being coextensive with and extending away from said perimeter edge, said perimeter wall having a distal edge with respect to said end wall, said distal edge forming an opening for receiving the light fixture, said perimeter wall being resiliently stretchable, said perimeter wall tapering inwardly from said end wall to said distal edge.

2. The light color emission changing system of claim 1, wherein said base is electrically coupled to a power supply.

3. The light color emission changing system of claim 1, wherein said light emitter comprises a light emitting diode.

4. The light color emission changing system of claim 1, wherein said covering comprises a translucent material.

5. The light color emission changing system of claim 2, further including a switch being electrically coupled to said base and being configured for turning on and off the power supply to the base.

6. The light color emission changing system of claim 4, wherein said translucent material is a plastic material.

7. A light color emission changing system comprising:

a light fixture including:

a base including a socket being mounted on a support, said base being electrically coupled to a power supply, a switch being electrically coupled to said base and being configured for turning on and off the power supply to the base; and a light emitter being engaged with said socket and emitting light when turned on having a white hue, said light emitter comprising a light emitting diode; and a covering being removably positionable over the light fixture such that only one color of light is emitted through the covering, said covering comprising a translucent material, said translucent material being a plastic material, said covering including:

an end wall having a perimeter edge, said end wall having a circular shape, said end wall being planar;

a perimeter wall being coextensive with and extending away from said perimeter edge, said perimeter wall having a distal edge with respect to said end wall, said distal edge forming an opening for receiving the light fixture, said perimeter wall being resiliently stretchable, said perimeter wall tapering inwardly from said end wall to said distal edge.

* * * * *